US008054944B2

(12) United States Patent
Freudenberger et al.

(10) Patent No.: US 8,054,944 B2
(45) Date of Patent: Nov. 8, 2011

(54) ELECTRON BEAM CONTROLLER OF AN X-RAY RADIATOR WITH TWO OR MORE ELECTRON BEAMS

(75) Inventors: Joerg Freudenberger, Kalchreuth (DE); Ernst Neumeier, Aurachtal (DE)

(73) Assignee: Siemens Aktiengesellschaft, Munich (DE)

( * ) Notice: Subject to any disclaimer, the term of this patent is extended or adjusted under 35 U.S.C. 154(b) by 78 days.

(21) Appl. No.: 12/555,104

(22) Filed: Sep. 8, 2009

(65) Prior Publication Data

US 2010/0061516 A1 Mar. 11, 2010

(30) Foreign Application Priority Data

Sep. 8, 2008 (DE) ..... 10 2008 046 288

(51) Int. Cl.
*H01J 35/06* (2006.01)

(52) U.S. Cl. ..... 378/134

(58) Field of Classification Search ..... 378/134
See application file for complete search history.

(56) References Cited

U.S. PATENT DOCUMENTS

| | | | |
|---|---|---|---|
| 4,065,689 | A | 12/1977 | Pleil |
| 4,748,650 | A | 5/1988 | Ammann |
| 5,844,963 | A | 12/1998 | Koller et al. |
| 6,480,572 | B2 | 11/2002 | Harris et al. |

FOREIGN PATENT DOCUMENTS

| | | |
|---|---|---|
| DE | 195 04 305 | 8/1996 |
| WO | WO 2007063479 A1 * | 6/2007 |

* cited by examiner

*Primary Examiner* — Hoon Song
*Assistant Examiner* — Mona M Sanei
(74) *Attorney, Agent, or Firm* — Schiff Hardin LLP

(57) ABSTRACT

An x-ray tube has a number of emitters that generate respective electron beams, and has a common anode at which the electron beams strike on a surface to generate x-rays. A high x-ray dose power with a long lifespan are achieved while being able to quickly vary the x-ray dose power by using a superimposed intensity distribution from the x-ray beams, which is measured by a detector, to optimize the x-ray beams on the surface.

6 Claims, 1 Drawing Sheet

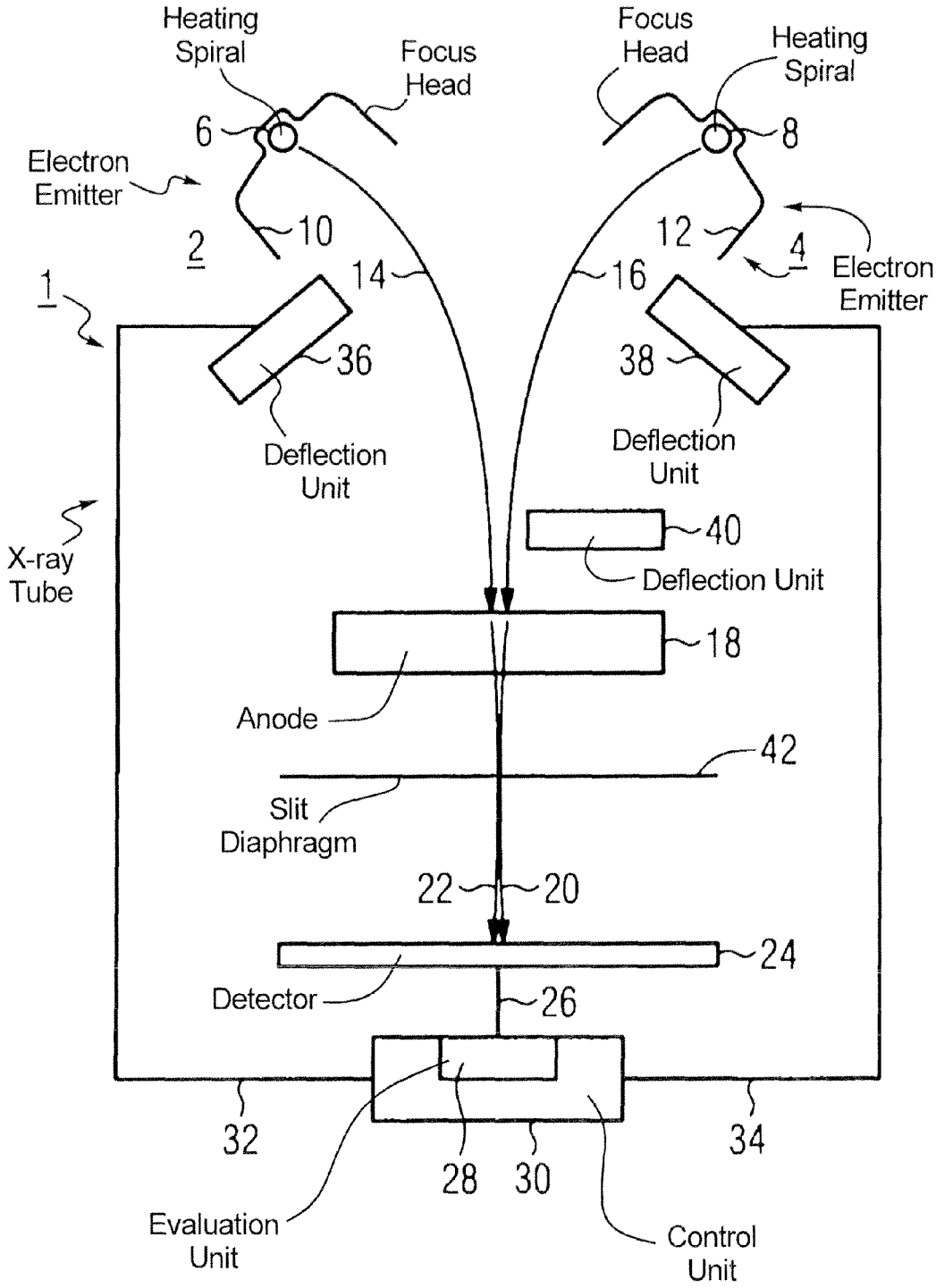
Heating Spiral
Focus Head
Focus Head
Heating Spiral
6
8
Electron Emitter
10
12
2
4
Electron Emitter
1
14
16
36
38
Deflection Unit
Deflection Unit
X-ray Tube
40
Deflection Unit
18
Anode
42
Slit Diaphragm
22
20
24
Detector
26
32
34
28
30
Evaluation Unit
Control Unit

ELECTRON BEAM CONTROLLER OF AN X-RAY RADIATOR WITH TWO OR MORE ELECTRON BEAMS

BACKGROUND OF THE INVENTION

1. Field of the Invention

The present invention concerns a method for operation of an x-ray tube of the type having a number of emitters that generate respective electron beams, and an anode at which the electron beams strike on a surface to generate x-rays. The invention additionally concerns an x-ray tube with a number of emitters and a common anode.

2. Description of the Prior Art

An x-ray tube in its simplest form is composed of a cathode and an anode that are situated in a vacuum within a sealed glass body. In high-power tubes as they are used in computed tomography (CT) and angiography, the vacuum container is formed of metal which withstands significantly greater heat effects. In the course of time, tech improvements have also been made to the x-ray tubes but these changes have not changed the basic principle of the generation of x-rays.

To generate the x-rays, electrons are emitted from the cathode (the emitter) and are accelerated toward the anode by means of an applied high voltage. This electron beam penetrates into the anode material and is thereby braked (decelerated). In principle three different radiation types are generated by the braking of the individual electrons. One of these radiation types is the characteristic x-ray radiation that, depending on the anode material that is used (and therefore on the radiation structure), possesses a characteristic or, respectively, discrete spectrum and has its origin in a transition of electrons from high-energy shells of the atomic shell to low-energy shells. However, this characteristic x-ray radiation is not used (or is used only in small part) for image generation in an x-ray radioscopy, with the exception of mammography and crystal analysis.

The more important or greater part of the radiation types that is used is the x-ray bremsstrahlung. This arises due to the braking of electrons upon passing through the material of the anode. The wavelength of this radiation depends on the value of the acceleration (or braking), such that harder (i.e. higher energy) x-ray radiation is created at high acceleration voltage or anode voltage. The bremsstrahlung spectrum has a minimum wavelength at which the entire kinetic energy of the electron is emitted in a single photon. The third generated radiation type is the transition radiation or Lilienfeld radiation, but this cannot be employed in the medical use of x-ray tubes.

An x-ray tube with two emitters is known from DE 195 04 305 A1, for example. The one emitter generates a larger focal spot and the other emitter generates a smaller focal spot arranged within the larger focal spot on the anode, such that a resulting focal spot arises.

Application fields of x-ray tubes are, for example, in medicine in the radioscopy of bodies for analysis of illnesses or fractures or, respectively, in luggage inspection, or even for non-destructive materials testing (for example in the quality control of welding seams). The x-rays are thereby directed through the medium to be examined and captured by a photo plate or a similar image generating unit. The blackening of the photo plate is inversely proportional to the density of the medium being traversed. Fractures or material weakenings can be detected in a simple manner.

Particularly in the application of x-ray tubes in computed tomography, a high intensity or a variable setting of the intensity of the x-rays is frequently desired. However, for the most part this cannot be achieved in the x-ray tube due to structural and material-related limitations. In particular, the lifespan of the emitters is severely shortened given the generation of very high electron currents given lower high voltage values. Furthermore, an optimal focusing of the x-ray beam generated in the anode cannot occur at high electron currents since an expansion of the focal spot size on the anode ensues due to the repulsion of the electrons among one another due to space charge effects.

SUMMARY OF THE INVENTION

An object of the invention is to provide an x-ray tube and a method for operating an x-ray tube of the aforementioned type that enable a high x-ray dose power with a long lifespan. Furthermore, the x-ray dose power can be varied quickly.

In a method for operation of an x-ray tube, this object is achieved according to the invention by the use of a superimposed intensity distribution from at least two x-ray beams, which is measured by a detector, for optimization of the x-rays on the anode surface.

The invention proceeds from the insight that, based on space charge effects and the lifespan of the emitter, an increase of the intensity of the resulting x-ray beam can be achieved when the resulting x-ray beam is generated by electron beams in multiple emitters. Given the simultaneous operation of multiple emitters, it is important that a focusing of the two electron beams on a common focus is possible. In order to achieve such a common focus, a spatially resolving detector is provided that measures and correspondingly evaluates the superimposed intensity distribution of the x-ray beam. These data serve for the alignment of the electron beams for positioning the source locations of the x-ray beams on the anode, and therefore for the focusing of the x-ray beams.

For a particularly precise focusing of the x-ray beams, the second moment of the distribution (thus the variance or dependent variables, for example the half width of the distribution) is advantageously measured and this is minimized via corresponding alignment of the electron beams. A particularly spot-accurate focusing of the x-ray beams is thereby achieved.

In order to correspondingly align the electron beams or, respectively, to correspondingly deflect the electron beams to optimize the focus of the electron beam, in a particularly advantageous embodiment this occurs via a respective deflection unit associated with an emitter. These deflection units are individually controlled and can thus individually vary the beam direction of every electron beam. For example, this can occur via deflection magnets or similar force-exerting systems (for example electrostatic systems, plate capacitors) located in the deflection unit.

In order to achieve an optimally good matching of the individual deflection units among one another, in a particularly preferred embodiment the individual deflection units are controlled via a common control unit. This control unit normally comprises an evaluation unit and evaluates the intensity distribution of the x-rays. It subsequently sends the commands (optimized for each individual deflection unit) for deflection of the electron beams to the deflection units. The current data about the distribution of the x-ray dose can thereby be received and evaluated in real time. A control of the deflection units that is tailored to its necessity (and therefore a particularly good optimization of the source surface of the x-rays) is thus possible, whereby an even further improved focusing of the resulting x-ray beams from multiple emitters is enabled.

In order to also obtain an optimally variable x-ray dose in addition to the high x-ray dose that is possible via the focusing of multiple x-ray beams, in an advantageous embodiment the emitters are designed to generate electron beams of different intensity. It is thereby possible to easily adapt the electron beam dose to the desired values by suitable control of the emitters or activation of the emitters. A refocusing of the resulting x-ray beam is normally not required or, respectively, is conducted automatically by the control unit.

With regard to the x-ray tube, the cited object is achieved by a separate deflection unit being associated with every emitter. With such an arrangement it is possible to separately deflect the individual electron beams emitted by the emitter so that the common, superimposed x-ray beam is focused as best possible.

To improve the focusing of the x-ray beams, in a preferred embodiment the individual deflection units are connected with a common control unit. This control unit is advantageously connected with a detector capable of spatial resolution and measuring the intensity distribution, which detector measures the intensity distribution of the x-rays and correspondingly relays these to the control unit or, respectively, to the evaluation unit comprising the control unit. The control unit then sends control commands to the individual deflection units in order to thus achieve a focusing of the individual x-ray beams on a common focal spot.

An advantage achieved with the invention is that a focusing is possible through the use of the intensity distribution of the superimposed x-ray beams, even when the resulting x-ray beam is originally generated by multiple electron beams. Both a high x-ray dose power and a fast variation of the x-ray dose are thereby possible.

BRIEF DESCRIPTION OF THE DRAWINGS

The single FIGURE shows an exemplary embodiment of the invention as an x-ray tube with two emitters with respective deflection units associated with the emitters.

DESCRIPTION OF THE PREFERRED EMBODIMENTS

The x-ray tube 1 according to the FIGURE has two emitters 2, 4. These emitters 2, 4 respectively have heating spirals 6, 8 and focus heads 10, 12 for generation of electron beams 14, 16. These electron beams 14, 16 are deflected onto an anode 18. The electron beams 14, 16 are braked in the anode 18 and in particular generate x-ray bremsstrahlung in addition to the characteristic x-ray radiation and the transition radiation. The x-ray beams 20, 22 generated by this braking procedure in the anode 18 are mapped by a slit diaphragm 42 to a detector 24 with spatial resolution. This detector 24 measures the spatial distribution of the x-ray dose power or the intensity of the two superimposed x-ray beams 20, 22. The data measured in this way are sent from the detector 24 via a data line 26 to the evaluation unit 28 of a control unit 30. The evaluation unit 28 evaluates the data of the detector 24 with regard to the different moments of the distribution and passes the result to the control unit 30. This control unit 30 can individually control deflection units 36, 38 associated with emitters 2, 4 via control lines 32 and 34, and therefore can control the electron beams 14, 16 individually and independently of one another.

For the focusing of the two x-ray beams 20,22, the spatial distribution of the x-ray radiation is detected at the detector. An electron beam of an emitter can initially be varied by the control unit 30 via a deflection magnet associated with the emitter and be fixed at a desired position before the second electron beam is varied depending on the position of the first electron beam. Therefore, given a fixed position of the first x-ray beam the position of the second x-ray beam is varied until the width of the total distribution is minimal. For example, for this purpose the second moment of the distribution or variables dependent thereon (such as the half width of the distribution) are determined by the evaluation unit 28. If the width of the total distribution is minimal, the dose power distribution also has a maximum at the desired position.

Such a variation of the electron beams is possible since the distribution of the x-ray dose power is measured in a targeted manner at the detector, and each electron beam 14, 16 can be varied individually by a deflection unit 36, 38 associated with it. Likewise conceivable and possible (but not shown in the FIGURE for clarity) is the use of additional emitters with which an additional, separate deflection unit is respectively associated. The newly added electron beams are respectively varied, with the already set x-ray beams 20, 22 being operated with constant deflection. If a focusing of multiple x-ray beams ensues, the deflection of all electron beams 14, 16 can ensue via an additional deflection unit 40. In the exemplary embodiment according to the FIGURE, the deflection of the electron beams 14, 16 via the deflection units 36, 38, 40 ensues via electromagnets. However, any other form of the deflection is also conceivable.

Due to the division of the electron beams 14, 16 into multiple emitters 2, 4, a higher x-ray dose can be achieved without negatively affecting the lifespan of the emitters 2, 4. In that the electron beams 14, 16 form a sum electron beam, it is now particularly simple to rapidly vary the electron beam intensity and therefore the x-ray dose power. By deactivating one of the electron beams (for example by means of the typical methods such as variation of the grid voltage at the focus head or changing the heating power), the dose power can now be rapidly changed without the occurrence of times in which the electron beam 14, 16 or the focus of the x-ray beam 20, 22 is not situated at the desired position. In particular, the emitters 2, 4 of the exemplary embodiment are designed to generate electron beams of different intensity.

Such changes of the electron beam intensity are important in, for example, cardio applications in which 25% of the dose power should be continuously provided, and even 100% must be present in the rest phase of the heart. For example, it would be possible to have a first electron beam run at 25% and a second electron beam at 75%, and to activate or deactivate the latter corresponding to the rest phase of the heart. Furthermore, in the exemplary embodiment according to the FIGURE it is possible to quickly switch over the high voltage to the x-ray radiator. One emitter for the tube current would thereby be set to a lower voltage and the second would be set to a higher voltage. The two emitters 6, 8 are now correspondingly regulated with grid voltage synchronously with the switching of the high voltage. In practice, no time is lost, in contrast to which a variation of the tube current by approximately 50% of switching times of approximately 30 ms is required in current x-ray radiators.

The x-ray tube thus enables both an operation at high x-ray dose powers and a faster variation of the intensity.

Although modifications and changes may be suggested by those skilled in the art, it is the intention of the inventors to embody within the patent warranted hereon all changes and modifications as reasonably and properly come within the scope of their contribution to the art.

We claim as our invention:

1. A method for operating an x-ray tube, comprising the steps of:

from each of a plurality of different emitters, emitting an electron beam that strikes a surface of an anode, each electron beam, upon striking said surface of said anode, causing an x-ray beam to be generated from the surface of the anode, each x-ray beam having an intensity distribution and said x-ray beams, in combination, having a superimposed intensity distribution that is a superimposition of the respective intensity distributions of the x-ray beams;

with a detector, measuring said superimposed intensity distribution;

supplying the measured superimposed intensity distribution to a processor and, in said processor, optimizing emission of said x-rays from said surface of said anode dependent on said superimposed intensity distribution;

focusing said x-ray beams using respective deflection units that respectively interact with the respective electron beams emitted by said different emitters; and controlling each of said deflection units with a common control unit dependent on said superimposed intensity distribution.

2. A method as claimed in claim 1 comprising, in said processor, identifying a second moment of said superimposed intensity distribution and using said second moment as a criterion for focusing said x-ray beams to optimize said emission of said x-ray beams from said surface of said anode.

3. A method as claimed in claim 1 comprising emitting said electron beams with respectively different intensities from said plurality of emitters.

4. An x-ray tube, comprising:

an anode;

a plurality of different emitters that each emit an electron beam that strikes a surface of said anode, each electron beam, upon striking said surface of said anode, causing an x-ray beam to be generated from the surface of the anode, each x-ray beam having an intensity distribution and said x-ray beams, in combination, having a superimposed intensity distribution that is a superimposition of the respective intensity distributions of the x-ray beams;

a detector that measures said superimposed intensity distribution;

a processor supplied with the measured superimposed intensity distribution, said processor being configured to optimize emission of said x-rays from said surface of said anode dependent on said superimposed intensity distribution;

deflection units that respectively focus said x-ray beams by respectively interacting with the respective electron beams emitted by said different emitters; and a common control unit that controls each of said deflection units dependent on said superimposed intensity distribution.

5. An x-ray tube as claimed in claim 4 wherein said processor is configured to identify a second moment of said superimposed intensity distribution and to use said second moment as a criterion for focusing said x-ray beams to optimize said emission of said x-ray beams from said surface of said anode.

6. An x-ray tube as claimed in claim 4 wherein said different emitters respectively emit said electron beams with different intensities.

* * * * *